US011186114B2

(12) United States Patent
Sato

(10) Patent No.: US 11,186,114 B2
(45) Date of Patent: Nov. 30, 2021

(54) DIRECT LIQUID-TYPE BRUSH PEN

(71) Applicant: TAISEI CO., LTD., Saitama (JP)

(72) Inventor: Tadayuki Sato, Saitama (JP)

(73) Assignee: TAISEI CO., LTD., Saitama (JP)

( * ) Notice: Subject to any disclaimer, the term of this patent is extended or adjusted under 35 U.S.C. 154(b) by 98 days.

(21) Appl. No.: 16/607,201

(22) PCT Filed: Oct. 24, 2018

(86) PCT No.: PCT/JP2018/039474

§ 371 (c)(1),
(2) Date: Oct. 22, 2019

(87) PCT Pub. No.: WO2019/150673

PCT Pub. Date: Aug. 8, 2019

(65) Prior Publication Data

US 2020/0384794 A1 Dec. 10, 2020

(30) Foreign Application Priority Data

Feb. 5, 2018 (JP) ..... JP2018-017871

(51) Int. Cl.
*B43K 8/04* (2006.01)
*B43K 8/03* (2006.01)

(52) U.S. Cl.
CPC . *B43K 8/04* (2013.01); *B43K 8/03* (2013.01)

(58) Field of Classification Search
CPC ..... A45D 2034/005; A46B 11/0065; A46B 11/0079; B43K 5/145; B43K 5/1854;
(Continued)

(56) References Cited

U.S. PATENT DOCUMENTS 3,589,824 A * 6/1971 Andrews ..... B43K 5/1872 401/176
4,408,921 A * 10/1983 Nagai ..... B43K 23/126 401/116

(Continued)

FOREIGN PATENT DOCUMENTS

FR 3086147 B3 * 12/2020 ..... A45D 34/00

*Primary Examiner* — David P Angwin
*Assistant Examiner* — Bradley S Oliver
(74) *Attorney, Agent, or Firm* — Browdy and Neimark, PLLC

(57) ABSTRACT

Provide is a direct liquid type writing-brush pen that is equipped with a valve mechanism; and with which the ink tube is of replaceable cartridge type, and the writing brush tip is always impregnated with an appropriate amount of ink while the ink leakage being suppressed, whereby an excellent feeling of writing can be always given. A direct liquid type writing-brush pen, including a barrel, which holds a writing brush tip unit at the distal end part thereof; an ink cartridge, which is slidably and detachably fitted into the barrel from the basal end side thereof; a cap, which covers the writing brush tip unit; and a stopper, which is fitted to the basal end part of the barrel to slidably support the basal end part of the ink cartridge, which is protruded from the basal end side of the barrel, wherein, in the distal end part of the ink cartridge, a valve mechanism, which accommodates a valve core in a valve seat, is incorporated; in the valve seat, the distal end part of the valve core is removably connected to the basal end part of a relay core, which constitutes the writing brush tip unit; and on the circumferential face of a smaller diameter part of the valve seat, a sealing strip is formed.

4 Claims, 9 Drawing Sheets

(58) Field of Classification Search
CPC ..... B43K 5/1872; B43K 8/03; B43K 8/04; B43K 8/12; B65D 2583/005
USPC ..... 222/325
See application file for complete search history.

(56) References Cited

U.S. PATENT DOCUMENTS

| | | | | | |
|---|---|---|---|---|---|
| 4,712,937 | A * | 12/1987 | Schmidt | B43K 5/14 | 401/199 |
| 4,993,437 | A * | 2/1991 | Kimura | A46B 11/0013 | 132/112 |
| 5,035,525 | A * | 7/1991 | Konose | B43K 5/1872 | 401/278 |
| 7,850,385 | B2 * | 12/2010 | Noguchi | B43K 5/025 | 401/198 |
| 7,854,562 | B2 * | 12/2010 | Peterson | A46B 11/0079 | 401/186 |
| 8,177,452 | B2 * | 5/2012 | Tsai | A45D 34/042 | 401/272 |
| 9,132,070 | B2 * | 9/2015 | Hayakawa | A61K 8/894 | |
| 2007/0172307 | A1 * | 7/2007 | Jo | A45D 34/042 | 401/279 |

* cited by examiner

DIRECT LIQUID-TYPE BRUSH PEN

FIELD OF TECHNOLOGY

The present invention relates to a direct liquid type writing-brush pen, and more particularly, to a direct liquid type writing-brush pen with which the ink tube is a replaceable cartridge.

BACKGROUND

Conventionally, a variety of direct liquid type pens have been available, however, with such pen of direct liquid type, there is the possibility that an excessive amount of ink may be oozed out into the core, resulting in occurrence of a phenomenon of so-called ink dripping, and thus pens of valve type, with which the ink is soaked into the core through a valve mechanism that can be opened by pushing in the core, have been increasingly used.

In the patent documents of Japanese Unexamined Patent Application Publication No. 2001-150866 and Japanese Unexamined Patent Application Publication No. 2001-341487, there is disclosed a knock type applicator as a writing instrument that is equipped with such valve mechanism, and with which the ink tube is a replaceable cartridge.

SUMMARY

The above-mentioned applicator that has been conventionally proposed, which has a valve mechanism, and with which the ink tube is a replaceable cartridge, may present no significant problem when the ink used has a relatively high viscosity, however, if such an applicator, for which it cannot be said that particularly the portion where the main body is engaged with the cartridge is provided with a sufficiently high scalability, were applied to a writing-brush pen, which is an application object of the present invention, there would be a high possibility that ink leakage, which is a fatal defect of a pen, or drying-up of the ink resulting from ink leakage at the time of storage for a long period of time, may be caused.

Further, with the above-mentioned conventional applicator, in order to prevent ink dripping and frequent knocking being caused, there is provided a configuration in which the side peripheral part of the writing brush tip is surrounded with an occluding body, such as a porous material or a foamed article. Therefore, the configuration poses a problem that the writing brush tip must be unnecessarily longer in order to accommodate the occluding body, and another problem that it is difficult to make an assembling operation in which the occluding body is to be set to the writing brush tip.

The present invention has been made to solve such problems involved in the prior art, and is intended to provide a direct liquid type writing-brush pen that is equipped with a valve mechanism and with which the ink tube is of replaceable cartridge type, the ink leakage being suppressed while the writing brush tip being always impregnated with an appropriate amount of ink, whereby an excellent feeling of writing can always be given.

The invention according to claim 1 for solving the above problems is a direct liquid type writing-brush pen, including a barrel, which holds a writing brush tip unit at the distal end part thereof; an ink cartridge, which is slidably and detachably fitted into the barrel from the basal end side thereof; a cap, which covers the writing brush tip unit; and a stopper, which is fitted to the basal end part of the barrel to slidably support the basal end part of the ink cartridge, which is protruded from the basal end side of the barrel, wherein, in the distal end part of the ink cartridge, a valve mechanism, which accommodates a valve core in a valve seat, is incorporated; in the valve seat, the distal end part of the valve core is removably connected to the basal end part of a relay core, which constitutes the writing brush tip unit; and on the circumferential face of a smaller diameter part of the valve seat, a sealing strip is formed.

In one embodiment, the writing brush tip unit is composed of the relay core; a writing brush tip, which is fitted to the distal end part of the relay core; a holder, which accommodates and holds the relay core and the writing brush tip, being fitted into the distal end part of the barrel; and a mouth inner, which is fitted into the holder, the mouth inner being composed of a larger diameter part and a reduced diameter part, and the reduced diameter part being pressed by the distal end part of a return spring, which urges the valve mechanism.

In another embodiment, the valve mechanism is composed of the valve seat, with which one half part thereof is fitted into the distal end part of the ink cartridge, and a smaller diameter part thereof as the other half part thereof is slidably inserted into the mouth inner; the valve core, which is disposed in the valve seat; a valve case, which closes a bore part in the basal end part of the valve seat; and a coil spring, which is disposed between the valve core and the valve case for always urging the valve core toward the distal end side thereof.

In another embodiment, in the smaller diameter part of the valve seat, a sealing strip is formed by two-color molding. In another embodiment, the relay core is composed of a shaft part, which, in the basal end part thereof, has an insertion opening, into which the distal end part of the valve core is insertably inserted, and a circular partition part, which is formed in the middle part of the shaft part, and on the inner peripheral face of a portion of the holder that is to be fitted to the circular partition part, a plurality of ink passage grooves, which extend in an axial direction, are formed.

The writing-brush pen in accordance with the present invention is configured as described above, and offers advantages that the ink tube is of replaceable cartridge type, which is advantageous in economy; that it is of direct liquid type and equipped with a valve mechanism; and that it is provided with a sealing strip in a portion of the smaller diameter part of the valve seat where the main body is engaged with the cartridge, thereby ink leakage from that portion being prevented; and particularly, with the invention claimed in claim 2, the reduced diameter part of the mouth inner is pressed by the distal end part of the return spring, which urges the valve mechanism, resulting in the sealing strip being clamped, thereby ink leakage being more reliably prevented, and thus it can be always used in a comfortable state.

BRIEF DESCRIPTION

Some of the embodiments will be described in detail, with reference to the following figures, wherein like designations denote like members, wherein.

DETAILED DESCRIPTION

Figure 1A:
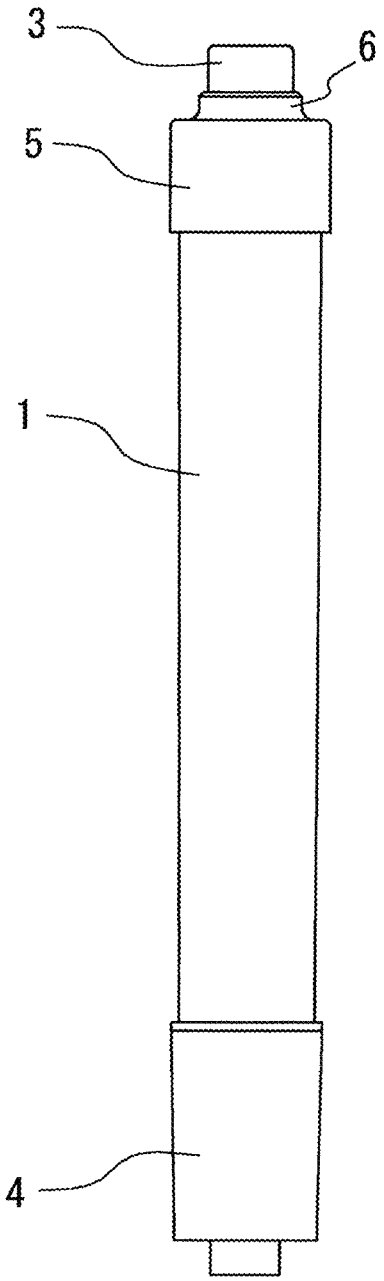
FIG. 1 is a front view of a direct liquid type writing-brush pen in accordance with an embodiment of the present invention, FIG. 1 (A) showing it at the time of a cap being fitted, while FIG. 1 (B) it at the time of the cap being removed.
Figure 1B:
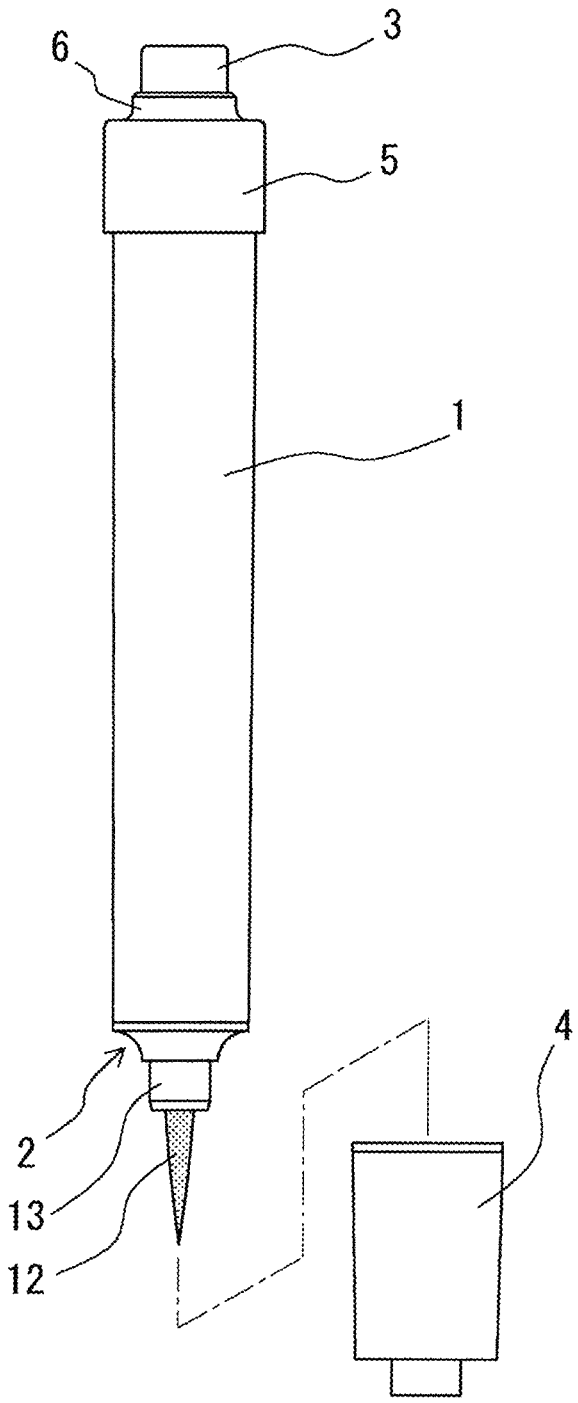

Hereinbelow, embodiments in accordance with the present invention will be explained with reference to the attached drawings. FIG. 1 is a front view of a direct liquid type writing-brush pen in accordance with an embodiment of the present invention, FIG. 1 (A) showing it at the time of a cap being fitted, while FIG. 1 (B) it at the time of the cap being removed, and FIG. 2 is a longitudinal sectional view of a direct liquid type writing-brush pen in accordance with an embodiment of the present invention, FIG. 2 (A) illustrating the movement of each part thereof at the time of non-knocking, while FIG. 2 (B) illustrating the movement of each part thereof at the time of knocking.

As shown in these figures, the direct liquid type writing-brush pen in accordance with the present invention is composed of a barrel 1, which holds a writing brush tip unit 2 at the distal end part thereof; an ink (liquid sumi ink) cartridge 3, which is slidably and detachably fitted into the barrel 1; a cap 4, which covers the writing brush tip unit 2; and a stopper 5, which is fitted to the basal end part of the barrel 1 to slidably support the basal end part of the ink cartridge 3, which is protruded from the basal end side of the barrel 1. Having a neck part 6, the stopper 5 slidably supports the basal end part of the ink cartridge 3, which protrudes from the basal end side of the barrel 1, and provides a function of preventing the ink cartridge 3 from coming off.

Figure 2A:
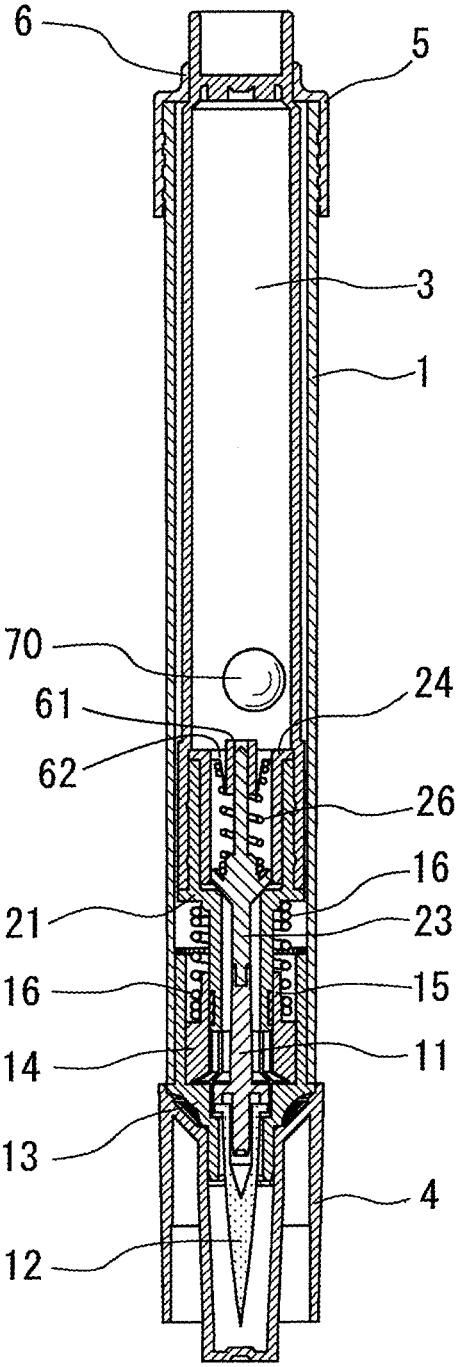
FIG. 2 is a longitudinal sectional view of a direct liquid type writing brush pen in accordance with an embodiment of the present invention, FIG. 2 (A) illustrating the movement of each part thereof at the time of non-knocking, while FIG. 2 (B) illustrating the movement of each part thereof at the time of knocking.
Figure 2B:
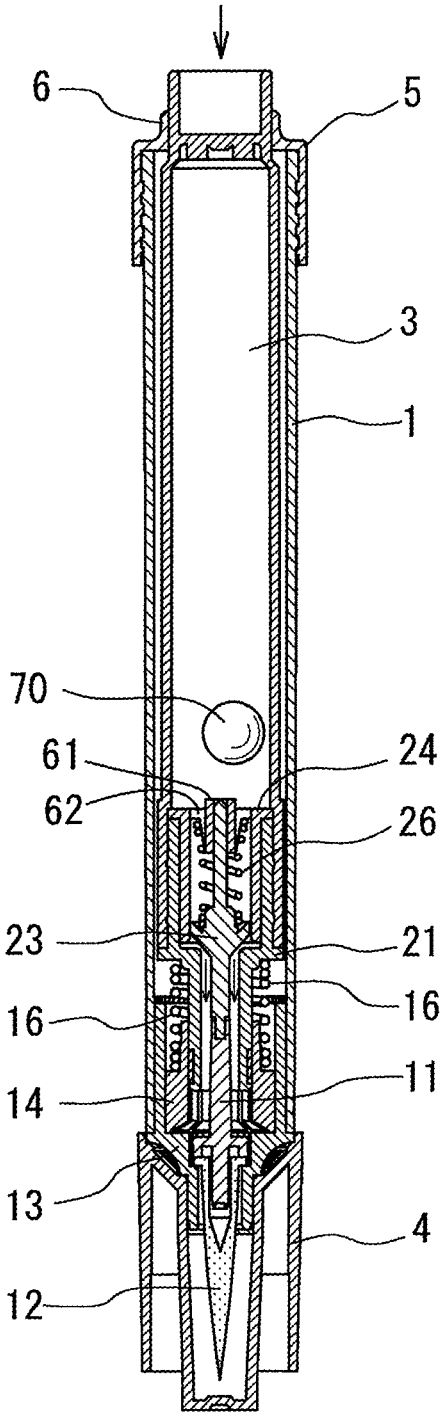
Figure 3:
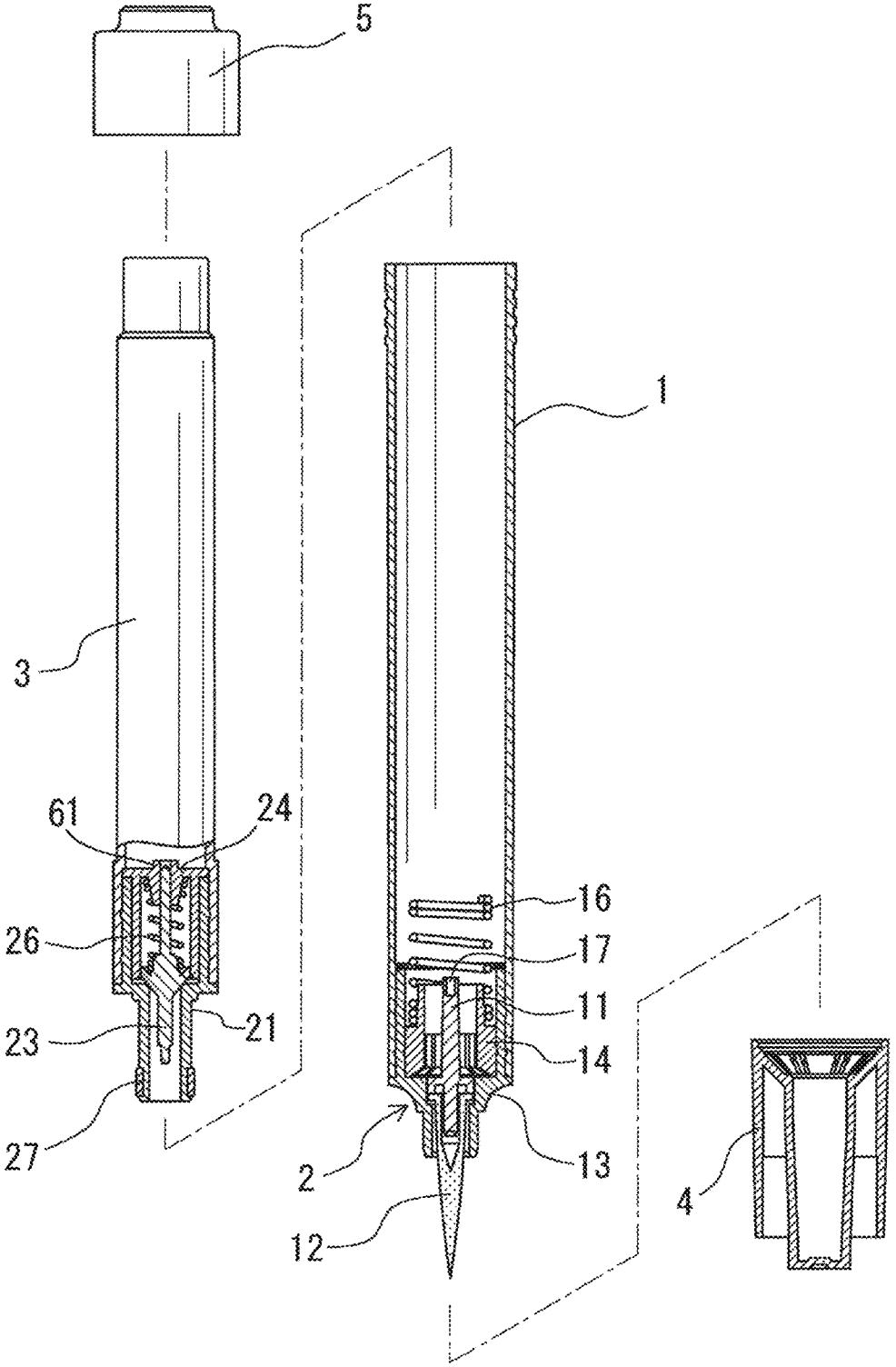
FIG. 3 is an exploded partly sectional view of a direct liquid type writing-brush pen in accordance with an embodiment of the present invention.
Figure 5A:
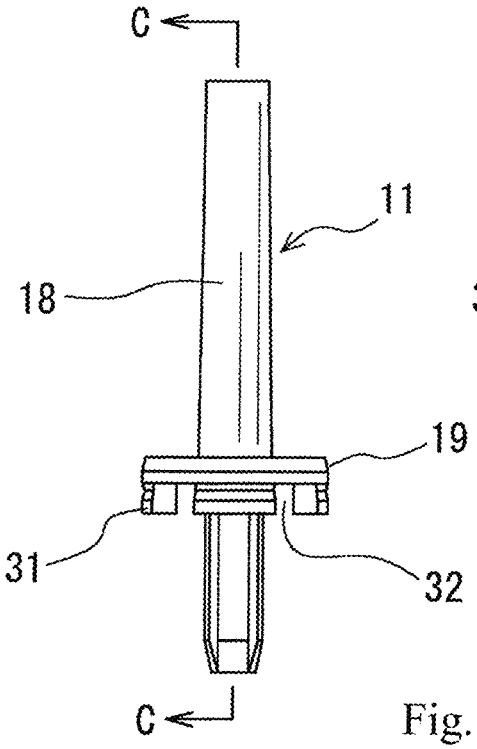
FIG. 5 shows a configuration of a relay core in a direct liquid type writing-brush pen in accordance with the present invention, FIG. 5 (A) being a front view of the relay core, FIG. 5 (B) a longitudinal sectional view of the same, and FIG. 5 (C) bottom view of the same.
Figure 5B:
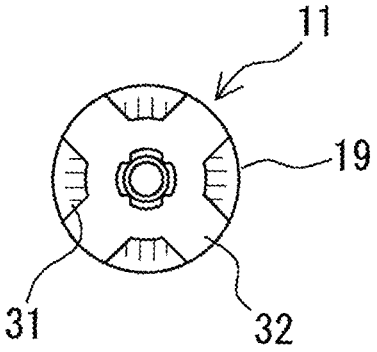
Figure 5C:
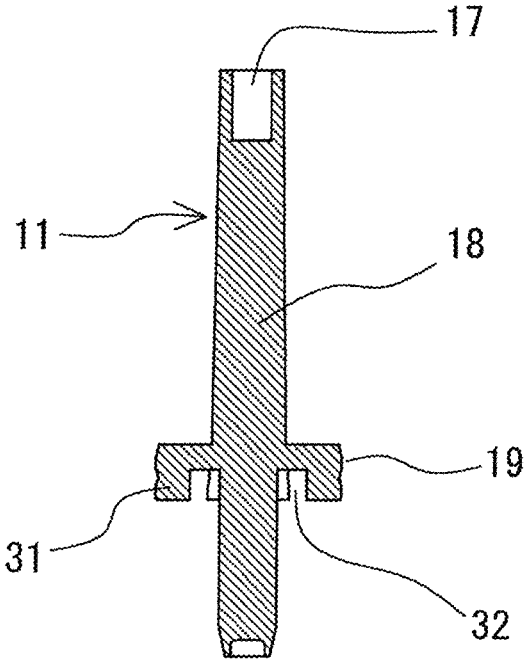
Figure 6A:
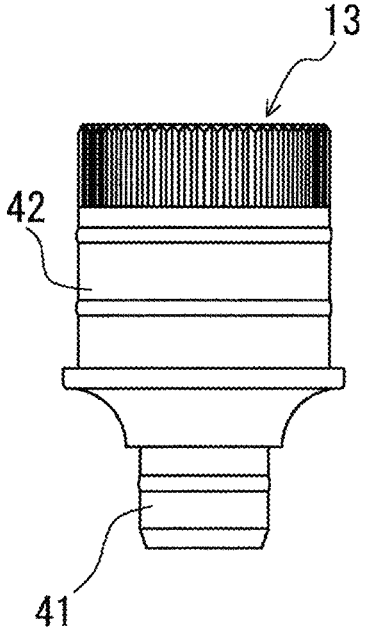
FIG. 6 shows a configuration of a holder in a direct liquid type writing-brush pen in accordance with the present invention, FIG. 6 (A) being a front view of the holder, FIG. 6 (B) a plan view of the same, FIG. 6 (C) a bottom view of the same, and FIGS. 6 (D) and (E) being longitudinal sectional views taken along the lines D-TD and E-E in the plan view, respectively.
Figure 6B:
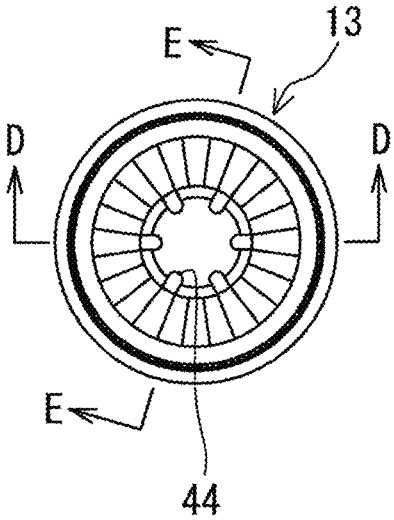
Figure 6C:
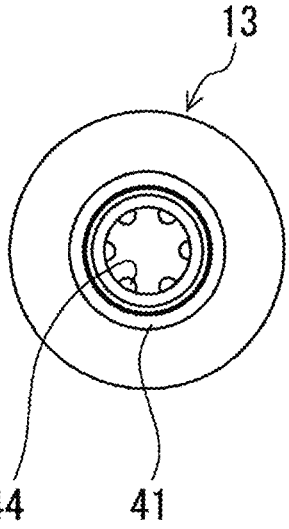
Figure 6D:
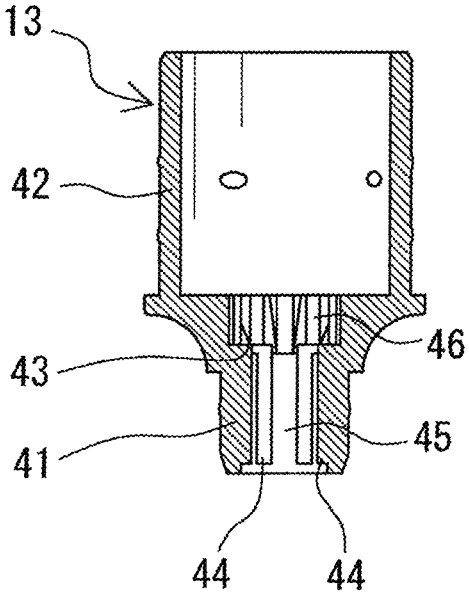
Figure 6E:
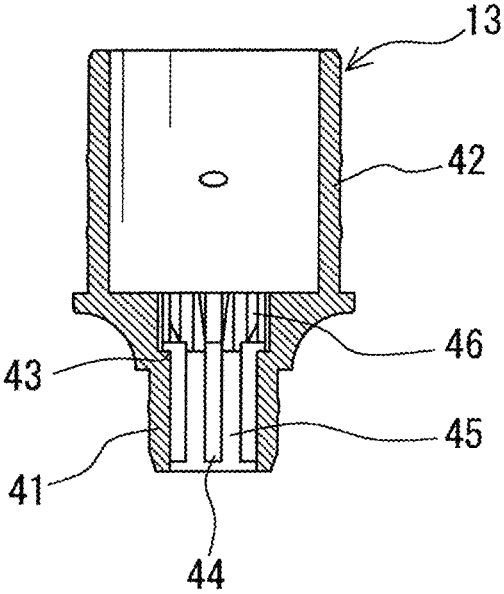

As shown in FIGS. 2, 3, and 5, in the distal end part of the ink cartridge 3, a valve mechanism, which accommodates a valve core 23 in a valve seat 21, is incorporated, and in the valve seat 21, the distal end part of the valve core 23 is removably connected to the basal end part of a relay core 11, which constitutes the writing brush tip unit 2. In FIG. 2, the sign 70 denotes a ball, which is a means for stirring the ink. The ink stirring means is not limited to a ball-shaped item, and may be such an item as a plastic bar having a specific gravity of 1.1 or over.

Figure 4:
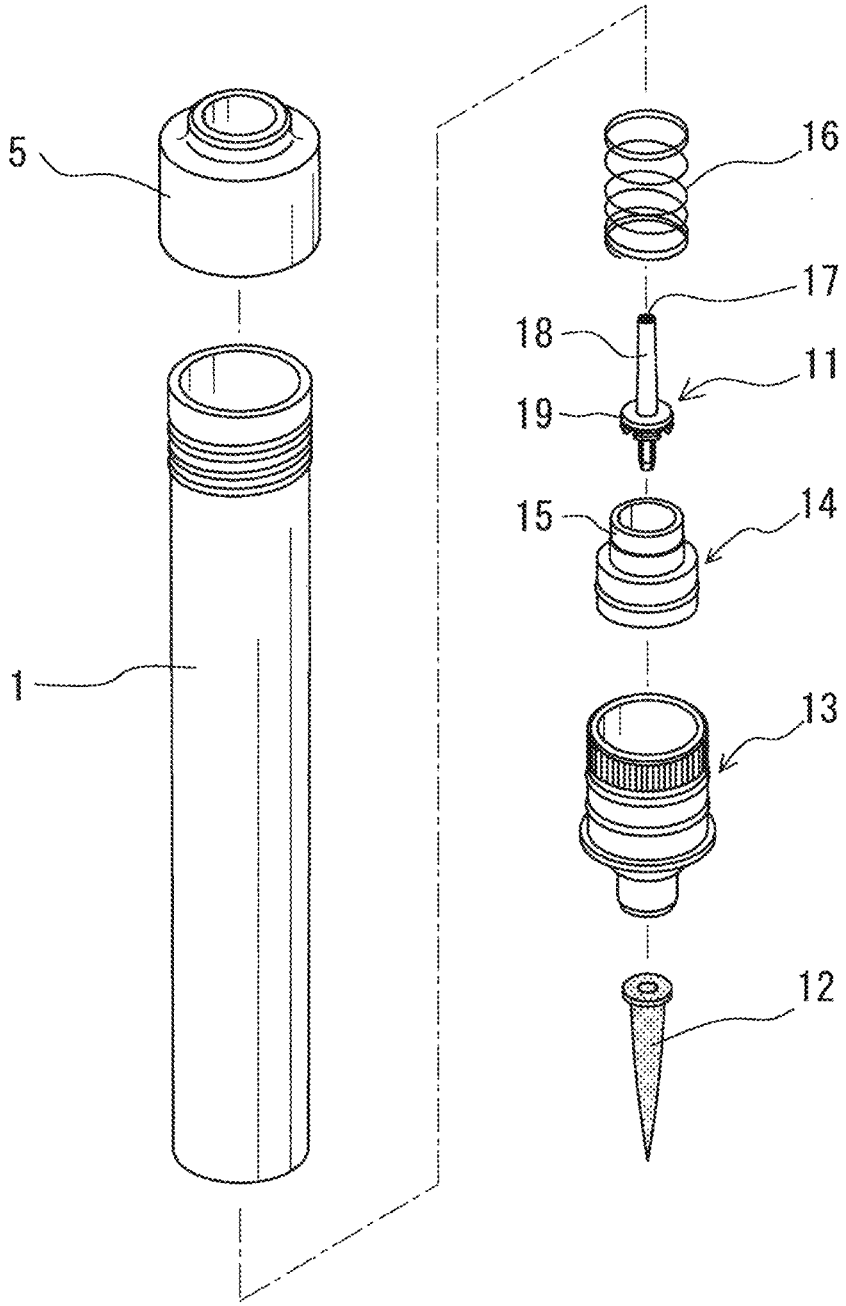
FIG. 4 is an exploded perspective view of a writing-brush unit part of a direct liquid type writing-brush pen in accordance with the present invention.

The writing brush tip unit 2 is composed of the relay core 11; a writing brush tip 12, which is fitted to the distal end part of the relay core 11; a holder 13, which accommodates and holds the relay core 11 and the writing brush tip 12, being fitted into the distal end part of the barrel 1; and a mouth inner 14, which is fitted into the holder 13 (refer to FIG. 4). The relay core 11 is composed of a shaft part 18, which, in the basal end part thereof, has an insertion opening 17, into which the distal end part of the valve core 23 is insertably inserted; and a circular partition part 19, which is formed in the middle part of the shaft part 18 (particularly, refer to FIG. 5). In the circumferential edge part of the circular partition part 19, a plurality of partition walls 31 are provided, the spacing between partition walls 31 serving as an ink circulation passage 32.

The holder 13 is composed of a smaller diameter part 41, which incorporates the writing brush tip unit 2; and a larger diameter part 42, which accommodates the mouth inner 14 (particularly, refer to FIG. 6). In an intermediate portion between the smaller diameter part 41 and the larger diameter part 42, there is provided a stepped part 43 for holding the circular partition part 19 of the relay core 11, and on the circumferential face of a bore part extending from the bottom of the stepped part 43 to the distal end part of the smaller diameter part 41, a protrusion strip 44 for supporting the writing brush tip 12 is formed with an ink groove 45 being formed between protrusion strips 44. In addition, on the circumferential face of a bore part extending from the bottom of the stepped part 43 to that of the larger diameter part 42, an ink groove 46 for introducing the ink to the inside of the circular partition part 19 of the relay core 11 is formed.

Figure 7A:
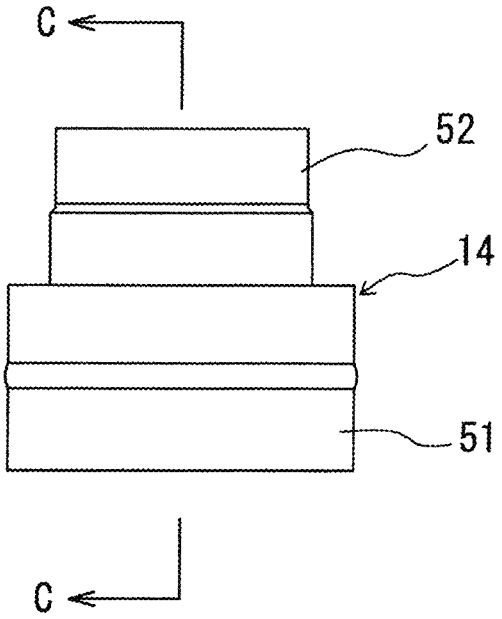
FIG. 7 shows a configuration of a mouth inner in a direct liquid type writing-brush pen in accordance with the present invention, FIG. 7 (A) being a front view, FIG. 7 (B) a bottom view, and FIG. 7 (C) a longitudinal sectional view.
Figure 7B:
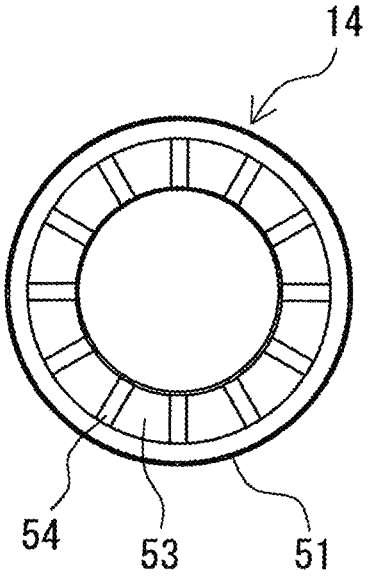
Figure 7C:
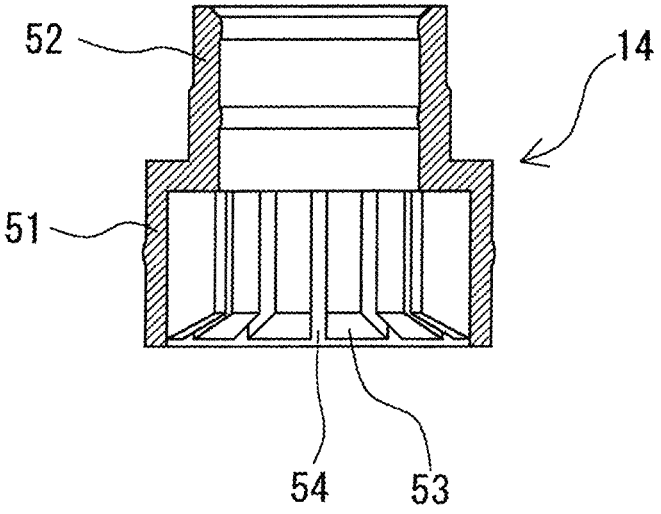

The mouth inner 14, which is accommodated in the larger diameter part 42 of the holder 13, is composed of a larger diameter part 51 and a reduced diameter part 52, and the distal end part of a return spring 16, which urges the ink cartridge 3 containing the valve mechanism, is wound over the reduced diameter part 52 (refer to FIGS. 2 and 7). In addition, into the reduced diameter part 52, a smaller diameter part 22 of the valve seat 21 is inserted (refer to FIG. 2). On the circumferential face of a bore part of a larger diameter part 51, into which the relay core 11 is inserted, a partition wall 53 is formed in a direction from the circumferential face to the relay core 11 such that the ink can be reserved in a slit 54 between partition walls 53, and then introduced into the smaller diameter part 41 of the holder 13.

Figure 8:
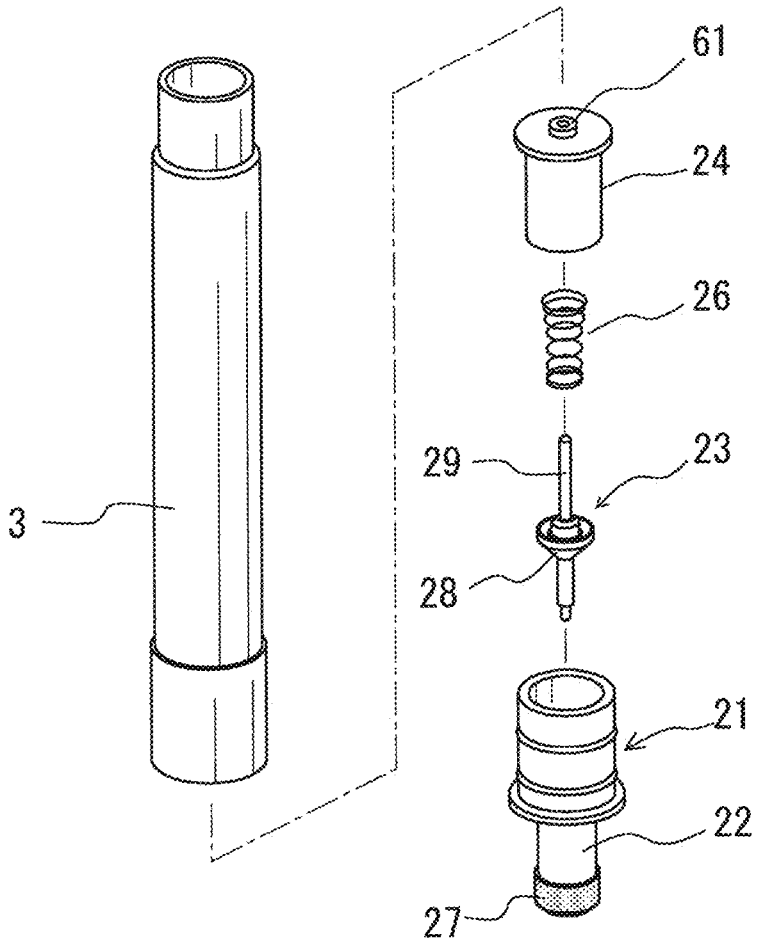
FIG. 8 is an exploded perspective view showing a configuration of a valve mechanism in a direct liquid type writing-brush pen in accordance with the present invention.
Figure 9:
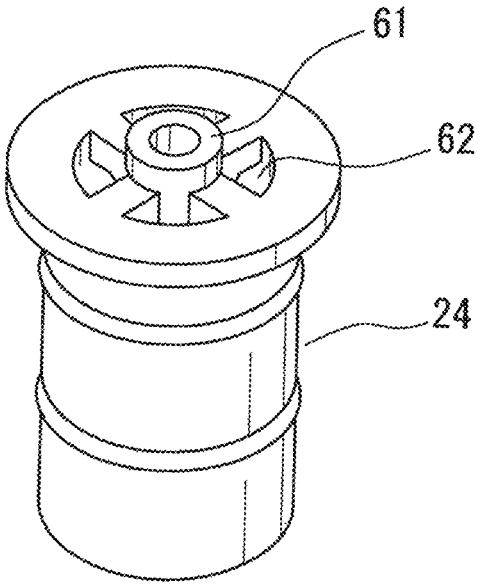
FIG. 9 is a perspective view showing a configuration of a valve case in a direct liquid type writing-brush pen in accordance with the present invention.

The valve mechanism is composed of a valve seat 21, with which one half part thereof is fitted into the distal end part of the ink cartridge 3, and a smaller diameter part 22 thereof as the other half part thereof is slidably inserted into the mouth inner 14; a valve core 23, which is disposed in the valve seat 21; a valve case 24, which closes a bore part in the basal end part of the valve seat 21; and a coil spring 26, which is disposed between the valve core 23 and the valve case 24 for always urging the valve core 23 in a direction toward the distal end thereof (refer to FIGS. 2 and 8).

On the circumferential face of the smaller diameter part 22 of the valve seat 21, which is to be slidingly contacted with the inner circumferential face of the mouth inner 14, a sealing strip 27 is formed by two-color molding to thereby prevent ink leakage from that portion.

The valve core 23 has a valve seat flange 28 in the middle part of the shaft part 29, the valve seat flange 28 being formed in a tapered shape to provide a valve seat, one end part of the coil spring 26 being supported by the inner top face of the valve case 24, while the other end part thereof being supported by the valve seat flange 28. At the center of the top face of the valve case 24, there is disposed a supporting cylinder 61, into which the basal end part of the valve core 23 is slidably inserted to be supported thereby, and around the supporting cylinder 61, ink flow-in inlets 62 are formed. The coil spring 26 is disposed such that the one end part thereof is wound around the supporting cylinder 61.

The direct liquid type writing-brush pen in accordance with the present invention is configured as described above, and is used for writing with the cap 4 being removed in the same way as with a general writing-brush pen. At the time of non-knocking illustrated in FIG. 2 (A), the ink (liquid semi ink) in the ink cartridge 3 gets into the valve case 24 through an ink flow-in inlet 62 in the top face of the valve case 24, which is always opened, filling the valve case 24 all the time. At the time of non-knocking, the valve core 23 is always urged by the coil spring 26, the tapered face thereof being caused to close the opening/closing port in the valve seat 21 (refer to FIG. 2 (A)). As a result of this, the ink that fills the inside of the valve case 24 will not flow out into the smaller diameter part 22 of the valve seat 21.

In writing, if the basal end part of the ink cartridge 3 is knocked, the valve mechanism is pressed down together with the ink cartridge 3, however, the valve core 23, the distal end part of which is jointed to the relay core stay in the original position. At that time, the basal end part of the valve core 23 is slid inside the supporting cylinder 61 of the valve case 24 with the coil spring 26 being compressed (refer to FIG. 2 (B)). In this way, with the valve core 23 being caused to stay in the original position, the tapered face thereof is left from the edge part of the opening/closing port in the valve seat 21, thereby the opening/closing port being opened. Thus, the ink in the valve case 24 is caused to flow out into the smaller diameter part 22 of the valve seat 21.

The ink that has got into the smaller diameter part 22 of the valve seat 21 will get into the ink grooves 46 and then 45 of the holder 13 through the slit 54 of the mouth inner 14 and the ink circulation passage 32 of the relay core 11, and from the ink groove 45, will ooze into the writing brush tip 12. In this way, the ink is supplied by an appropriate amount from the valve mechanism through the slit 54 and the ink circulation passage 32, and then, is oozed little by little into the writing brush tip 12 from the ink groove 45, which surrounds the writing brush tip 12, whereby ink dripping due to excessive supply will not be caused.

In one embodiment, the barrel 1, which provides a portion to be gripped by hand in writing, may be adapted to have a diameter of 15 to 18 mm, which is convenient for writing, and yet the quantity of ink to be contained in the ink cartridge 3 can be specified to be as sufficient as 3 to 5 cc, in spite of a complicated structure of cartridge type.

As described above, with the present invention, the configuration of conventional, general writing instrument, in which the side circumferential part of the writing brush tip is surrounded by an occluding body, has not been adopted, whereby the present invention offers advantages that there is no need for increasing the length of the writing brush tip in order to dispose the occluding body, and the labor and time for setting the occluding body around the writing brush tip can be saved.

In addition, there is provided a sealing strip 27 for the smaller diameter part 22 of the valve seat 21, in which the writing brush tip unit 2 and the ink cartridge 3 are engaged with each other, and the sealing strip 27 is tightly contacted with the inner peripheral face of the reduced diameter part 52 of the mouth inner 14, thereby ink leakage from that portion being prevented. Particularly, the reduced diameter part 52 of the mouth inner 14 is pressed by the distal end part of the return spring 16, which urges the valve mechanism, resulting in the sealing strip 27 being clamped, thereby ink leakage being more reliably prevented. Furthermore, at the time of long period of storage, there is no possibility that the ink may be dried up due to the ink leakage.

In this way, with the direct liquid type writing-brush pen in accordance with the present invention, the writing brush tip is always supplied with an appropriate amount of ink, and there is no possibility of ink leakage, allowing it to be always used in a comfortable state, and thus the direct liquid type writing-brush pen in accordance with the present invention provides a great industrial applicability.

The invention claimed is:

1. A direct liquid type writing-brush pen, comprising a barrel, which holds a writing brush tip unit at the distal end part thereof; an ink cartridge, which is slidably and detachably fitted into said barrel from the basal end side thereof; a cap, which covers said writing brush tip unit; and a stopper, which is fitted to the basal end part of said barrel to slidably support the basal end part of said ink cartridge, which is protruded from the basal end side of said barrel, wherein, in the distal end part of said ink cartridge, a valve mechanism, which accommodates a valve core in a valve seat, is incorporated; in said valve seat, the distal end part of said valve core is removably connected to the basal end part of a relay core, which constitutes said writing brush tip unit; and on the circumferential face of a smaller diameter part of said valve seat, a sealing strip is formed, and wherein said writing brush tip unit is composed of said relay core, a writing brush tip, which is fitted to the distal end part of said relay core, a holder, which accommodates and holds said relay core and said writing brush tip, being fitted into the distal end part of said barrel, and a mouth inner, which is fitted into said holder, said mouth inner being composed of a larger diameter part and a reduced diameter part, and the reduced diameter part being pressed by the distal end part of a return spring, which urges said valve mechanism.

2. The direct liquid type writing-brush pen according to claim 1, wherein said valve mechanism is composed of said valve seat, with which one half part thereof is fitted into the distal end part of said ink cartridge, and a smaller diameter part thereof as the other half part thereof is slidably inserted into said mouth inner; said valve core, which is disposed in said valve seat; a valve case, which closes a bore part in the basal end part of said valve seat; and a coil spring, which is disposed between said valve core and said valve case for always urging the valve core toward the distal end side thereof.

3. The direct liquid type writing-brush pen according to claim 2, wherein, in the smaller diameter part of said valve seat, a sealing strip is formed by two-color molding.

4. The direct liquid type writing-brush pen according to claim 1, wherein said relay core is composed of a shaft part, which, in the basal end part thereof, has an insertion opening, into which the distal end part of said valve core is insertably inserted, and a circular partition part, which is formed in the middle part of the shaft part, and on the inner peripheral face of a portion of said holder that is to be fitted to said circular partition part, a plurality of ink passage grooves, which extend in an axial direction, are formed.

* * * * *